US005966758A

United States Patent [19]

Karam

[11] Patent Number: 5,966,758

[45] Date of Patent: Oct. 19, 1999

[54] ADJUSTABLE DUST RUFFLE DEVICE

[76] Inventor: Linda Hilborn Karam, 2415 Ashbourne Dr., Lawrenceville, Ga. 30043

[21] Appl. No.: 08/948,683

[22] Filed: Oct. 10, 1997

[51] Int. Cl.[6] ..... A47G 9/04

[52] U.S. Cl. ..... 5/493; 5/482; 5/486; 24/72.5

[58] Field of Search ..... 5/493, 482, 486, 5/499, 633; 24/72.5; 297/228.11, 218.4

[56] References Cited

U.S. PATENT DOCUMENTS

| | | | |
|---|---|---|---|
| 3,999,233 | 12/1976 | Morris | 5/493 |
| 4,141,097 | 2/1979 | Levinson | 5/493 |
| 4,807,316 | 2/1989 | Whipple | 5/493 |
| 5,105,492 | 4/1992 | Karpinski | 5/493 X |
| 5,205,003 | 4/1993 | Green | 5/493 |
| 5,271,112 | 12/1993 | Bible | 5/493 |
| 5,353,456 | 10/1994 | Evans | 5/493 |
| 5,404,601 | 4/1995 | O'Neill | 5/493 |
| 5,483,712 | 1/1996 | Greenwood | 5/493 |
| 5,621,931 | 4/1997 | Hamilton | 5/493 |
| 5,632,068 | 5/1997 | Riley et al. | 297/228.11 X |
| 5,638,562 | 6/1997 | Masoncup | 5/493 |
| 5,802,637 | 9/1998 | Bardo | 5/663 X |

FOREIGN PATENT DOCUMENTS

| | | | |
|---|---|---|---|
| 12142 | 3/1903 | United Kingdom | 5/493 |
| 1404365 | 8/1975 | United Kingdom | 297/228.11 |

*Primary Examiner*—Terry Lee Melius
*Assistant Examiner*—Robert G. Santos
*Attorney, Agent, or Firm*—Hinkle & Associates, P.C.

[57] ABSTRACT

A dust ruffle assembly for forming dust ruffles using dust ruffle components on one, two, or three sides of a bed while allowing adjustments for height, fullness, bed size, and number of dust ruffle layers. The dust ruffle assembly is positioned between the mattress and box springs of a bed. Dust ruffle components are attached to strips, and the strips are fastened to support members. The device permits adjustment of the dust ruffle height to accommodate bed frames and foundations of different heights. The fullness of a dust ruffle layer is quickly adjusted by adding additional dust ruffle components. The strips and support members accommodate a range of mattress sizes, and the dust ruffle components are interchangeable on beds of different sizes. The support members accommodate multiple strips for forming more than one dust ruffle layer on one, two, or three sides of a bed.

12 Claims, 11 Drawing Sheets

ADJUSTABLE DUST RUFFLE DEVICE

BACKGROUND—FIELD OF INVENTION

This invention relates to devices and components for forming dust ruffles around the box springs of a bed.

BACKGROUND—DESCRIPTION OF PRIOR ART

Department, discount, and linen stores sell dust ruffles where three sides of fabric are sewn to a deck of material. Such dust ruffles are difficult to install between a mattress and a box springs without lifting the mattress. The height of the dust ruffle cannot be raised or lowered once the dust ruffle is positioned on top of the box springs. By using this particular type, the dust ruffles will appear shorter on some beds than on others. For example, when a dust ruffle hangs a fixed height from the top of box springs, the dust ruffle will be considerably shorter on a bed where the distance from the top of box springs to floor is 23" than it will be when it hangs from a bed where the distance from the top of box springs to floor is 15". Because the dust ruffle is attached to a deck of material, it cannot be lowered to accommodate the taller bed where the distance is 23" from the top of box springs to floor. If only one side of the dust ruffle needs to be cleaned, the entire dust ruffle must be removed. Since the deck of this type of dust ruffle is sewn to fit a bed of a specific size, a full-size dust ruffle will not fit on a king-size bed. When a foot board of a bed covers a portion of the dust ruffle, the end of bed portion of the dust ruffle cannot be removed to accommodate the foot board. Some bed frames and bed posts also interfere with the proper hanging of a dust ruffle when three sides are sewn to a deck of material. If more than one dust ruffle of the same size is placed one on top of the other on top of a box springs, the bottom ruffles will not be visible since they will be completely covered by the top ruffle. Also, the fullness of each dust ruffle layer cannot be adjusted when the dust ruffle is sewn to a deck of material.

Inventors have created other ways of forming dust ruffles on beds. U.S. Pat. No. 5,205,003 to Green (1993) discloses using hook and loop tape to fasten the dust ruffle to the cover member between the mattress and the box springs. This method requires the hook fastener to be aligned precisely on top of the loop fastener. This requirement limits adjustments for dust ruffle height, since the dust ruffle can only hang from the point where the hook and loop fasteners meet. This method does not allow additional dust ruffle material to be added for increasing the fullness of a dust ruffle.

U.S. Pat. No. 5,483,712 to Greenwood (1996) discloses retaining flaps for holding dust ruffles in place. This invention does not allow additional dust ruffle panels to be added for increased fullness, since the retaining flaps only hold a limited amount of fabric. Also, additional layers of dust ruffles cannot be inserted in retaining flaps, since the material is required to be sufficiently thin and light weight in order to be frictionally held by the retaining flaps. This method requires more installation time, since care must be taken to ensure the dust ruffle is gathered and spaced evenly in the various retaining flaps across the device.

U.S. Pat. No. 5,621,931 to Hamilton (1997) discloses a grip deck and grip skirt panels. This invention does not allow the grip deck to be installed without lifting the mattress. The grip deck is not interchangeable on beds of different sizes For example, a full-size grip deck cannot be used on a king-size bed. This method does not allow additional dust ruffle material to be added for increasing the fullness of a dust ruffle.

OBJECTS AND ADVANTAGES

Several objects and advantages of my invention are:

a) dust ruffle components are quickly and easily attached and removed;

b) dust ruffle components can be installed or changed without lifting mattress, c) dust ruffles are adjustable in height since beds vary in height from floor;

d) dust ruffles can be multi-layered to allow contrasting layers of fabric to be used without covering other layers of fabric;

e) no deck is required and the difficulties associated with inserting the deck between the mattress and box springs are eliminated;

f) dust ruffles can have one, two, or three sides to accommodate box springs resting on bed frames, foundations, poster beds, sleigh beds, day beds, or beds containing foot boards;

g) additional dust ruffle panels can be added to adjust fullness on one or more layers;

h) dust ruffle components can be easily interchanged on beds of different sizes;

i) dust ruffle devices can be easily interchanged on beds of different sizes;

j) all dust ruffle components do not need to be removed for cleaning if only one component is soiled.

Further objects and advantages will become noticeable from a consideration of the drawings and ensuing description.

DRAWING DESCRIPTION

BRIEF DESCRIPTION OF DRAWING FIGURES

In the drawings, closely related figures have the same number but different alphabetic suffixes.

FIG. 3A is a top plan view of the end of bed dust ruffle device having a top end strip, a bottom end strip, and two side support members wherein wire fasteners are utilized to connect the end strips to the side support members.

FIG. 3B is a top plan view of the end of bed dust ruffle device of FIG. 3A having two bottom end strips instead of one wherein wire fasteners are utilized to connect the end strips to the side support members.

DETAILED DESCRIPTION

Reference Numerals in Drawings

Figure 1A:
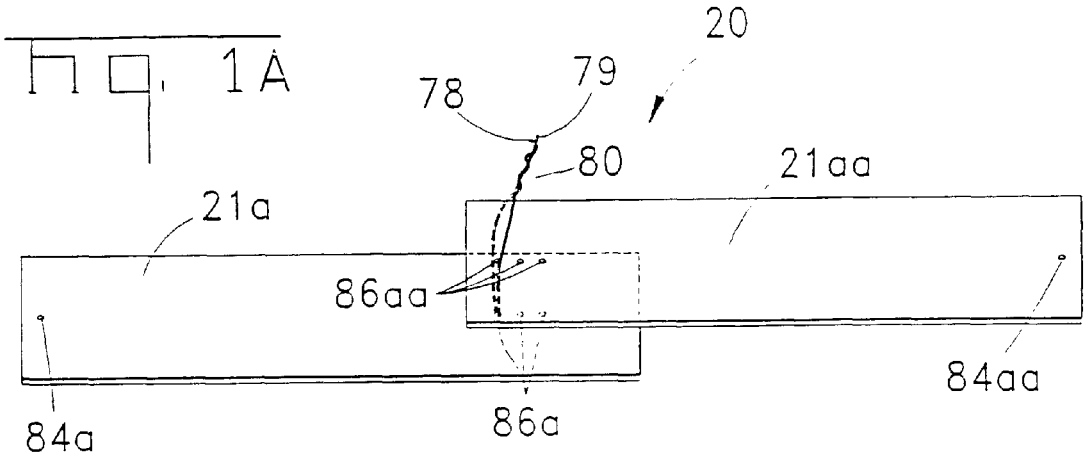
FIG. 1A is a plan view of the end strip device which consists of two strips where the adjacent portions are positioned and connected with a wire fastener to provide a resulting strip with a predetermined length.

20 end strip device is formed from a flexible material such as plastic and the like and contains a plurality of predetermined holes

21 end strip is formed from a flexible material such as plastic and the like and contains a plurality of predetermined holes

26 side support member device is formed from a flexible material such as plastic and the like and contains a plurality of predetermined holes

27 side support member is formed from a flexible material such as plastic and the like and contains a plurality of predetermined holes

30 end support member device is formed from a flexible material such as plastic and the like and contains a plurality of predetermined holes

31 end support member is formed from a flexible material such as plastic and the like and contains a plurality of predetermined holes

34 side strip device is formed from a flexible material such as plastic and the like and contains a plurality of predetermined holes

35 side strip is formed from a flexible material such as plastic and the like and contains a plurality of predetermined holes

40 box springs

42 end of bed dust ruffle device

44 side of bed dust ruffle device

70 dust ruffle component consists of one or more layers of fabric, or material, or lace, or lining arranged to form a dust ruffle having a pocket-like casing

72 pocket-like casing of dust ruffle component

78 first end of fastener component which comprises a piece of wire constructed from a malleable metal or alloy which may be covered with a material such as paper, cotton, or polymer

79 second end of fastener component which comprises a piece of wire constructed from a malleable metal or alloy which may be covered with a material such as paper, cotton, or polymer

80 fastener component comprises a piece of wire having a first end and a second end constructed from a malleable metal or alloy which may be covered with a material such as paper, cotton or polymer

82 height adjusting holes

84 connecting holes

86 length adjusting holes

101 top end of box springs

102 right side of box springs

103 bottom end of box springs

104 left side of box springs

105 top left corner of box springs

106 top right corner of box springs

107 bottom right corner of box springs

108 bottom left corner of box springs

DETAILED DESCRIPTION—FIGS. 1 to 7

FIG. 1A shows in detail an end strip device 20 which is comprised of a first end strip 21*a* and a second end strip 21*aa* positioned in relation to one another in order to connect first strip 21*a* to second strip 21*aa* to provide strip 20 with a length which is greater in length of either of strips 21*a* and 21*aa*. This allows strip 20 to be adjusted in length and thus useful on beds (not shown) of various sizes. Strip 20 is provided with a plurality of length adjusting holes 86 and connecting holes 84.

Figure 1B:
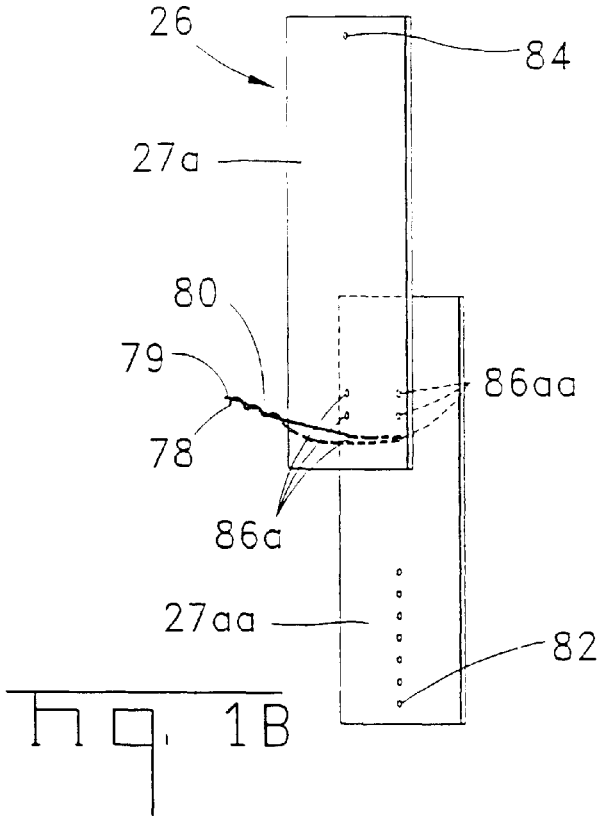
FIG. 1B is a plan view of the side support member device which consists of two support members where the adjacent portions are positioned and connected with a wire fastener to provide a resulting support with a predetermined length.

After approximate length is determined, first strip 21*a* is adjusted relative to second strip 21*aa* whereby at least one length adjusting hole 86*a* of first strip 21*a* is aligned with at least one length adjusting hole 86*aa* of second strip 21*aa*. A first end 78 of a fastener component 80 is inserted through the aligned holes 86*a* and 86*aa* of first and second strips 21*a* and 21*aa* and wound around a second end 79 of fastener 80 to allow strips 21*a* and 21*aa* to be connected in order to provide strip 20 with a length substantially equal to end 101 of a box springs 40 shown in FIG. 3A FIG. 1B shows in detail a side support member device 26 which is comprised of a first side support member 27*a* and a second side support member 27*aa* positioned and connected to provide support 26 with a length which is greater in length of either of supports 27*a* and 27*aa*. This allows support 26 to be adjusted in length and thus useful on beds (not shown) of various sizes. Support 26 is provided with a plurality of height adjusting holes 82, a plurality of length adjusting holes 86, and a connecting hole 84.

After approximate length is determined, first support 27*a* is adjusted relative to second support 27*aa* whereby at least one hole 86*a* of first support 27*a* is aligned with at least one hole 86*aa* of second support 27*aa*. First end 78 of fastener 80 is inserted through the aligned holes 86*a* and 86*aa* of first and second supports 27*a* and 27*aa*, and first end 78 is wound around second end 79 of fastener 80 to allow supports 27*a* and 27*aa* to be connected in order to provide support 26 with a length substantially equal to side 102 of box springs 40 shown in FIG. 3A.

Figure 1C:
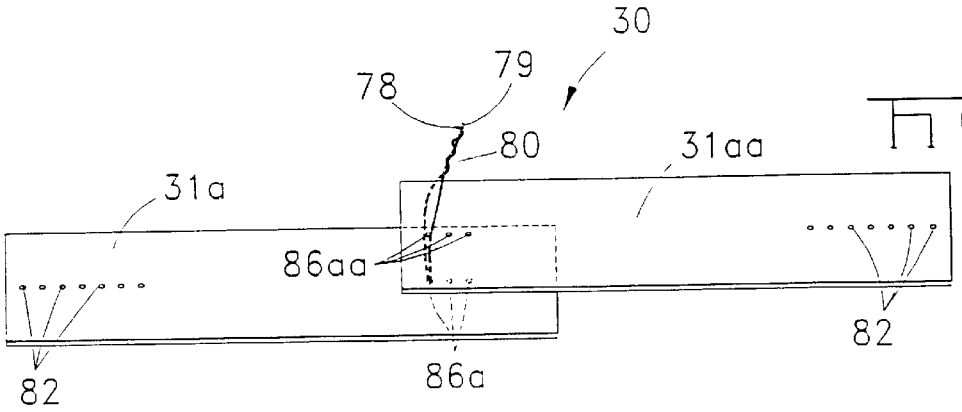
FIG. 1C is a plan view of the end support member device which consists of two supports where the adjacent portions are positioned and connected with a wire fastener to provide a resulting support with a predetermined length.

FIG. 1C shows in detail an end support member device 30 which is comprised of a first end support member 31*a* and a second end support member 31*aa* positioned and connected to provide support 30 with a length which is greater in length of either of supports 31*a* and 31*aa*. This allows support 30 to be adjusted in length and thus useful on beds (not shown) of various sizes. Support 30 is provided with a plurality of height adjusting holes 82 and length adjusting holes 86.

Figure 1D:
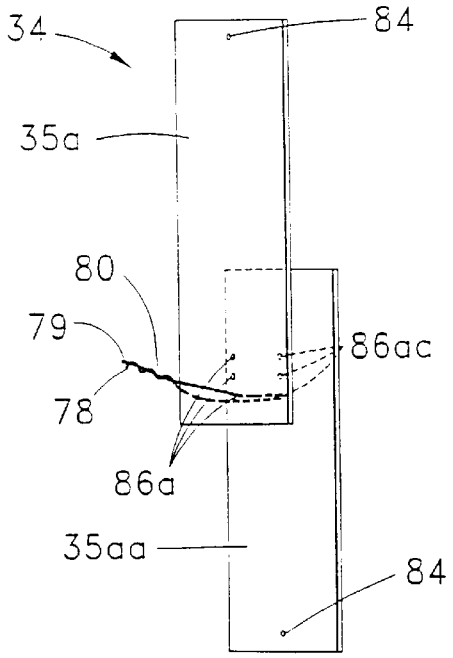
FIG. 1D is a plan view of the side strip device which consists of two strips where the adjacent portions are positioned and connected with a wire fastener to provide a resulting strip with a predetermined length.

After approximate length is determined, first support 31*a* is adjusted relative to second support 31*aa* whereby at least one hole 86*a* of first support 31*a* is aligned with at least one hole 86*aa* of second support 31*aa*. First end 78 of fastener component 80 is inserted through aligned holes 86*a* and 86*aa* of first and second supports 31*a* and 31*aa*, and first end 78 is wound around second end 79 of fastener 80 to allow supports 31*a* and 31*aa* to be connected in order to provide support 30 with a length substantially equal to end 101 of box springs 40 shown in FIG. 2A FIG. 1D shows in detail a side strip device 34 which is comprised of a first side strip 35*a* and a second side strip 35*aa* positioned and connected to provide strip 34 with a length which is greater in length of either of strips 35*a* and 35*aa*. This allows strip 34 to be adjusted in length and thus useful on beds (not shown) of different sizes. Strip 34 is provided with a plurality of length adjusting holes 86 and connecting holes 84.

After the approximate length is determined, first strip 35*a* is adjusted relative to second strip 35*aa* whereby at least one hole 86*a* of first strip 35*a* is aligned with at least one hole 86*aa* of second strip 35*aa*. First end 78 of fastener 80 is inserted through the aligned holes 86*a* and 86*aa* of first and second strips 35*a* and 35*aa*, and first end 78 is wound around second end 79 of fastener 80 to allow strips 35*a* and 35*aa* to be connected in order to provide strip 34 with a length substantially equal to side 102 of box springs 40 shown in FIG. 2A.

Although only one type of fastener component is shown in FIGS. 1A–1D, any fastener component that adequately performs the function stated herein may be used. For example, a shoe lace (not shown) can be inserted through length adjusting holes 86*a* and 86*aa* and tied together to secure strip 21*a* to strip 21*aa*, to secure support 27*a* to support 27*aa*, to secure support 31*a* to support 31*aa*, or to secure strip 35*a* to strip 35*aa*. Additionally, clamping or taping means (not shown) may be employed for fastening purposes.

FIG. 2A shows a top plan view of a side of bed dust ruffle device 44 for creating dust ruffles on sides 102 and 104 of box springs 40. Device 44 is comprised of the following: top end support 30*a* is placed on top of box springs 40 at top end 101; bottom end support 30*b* is placed on top of box springs 40 at bottom end 103; side strip 34*b* is placed on top of box springs 40 at side 102; side strip 34*a* is placed on top of box springs 40 at side 104. Supports 30*a* and 30*b* and strips 34*a* and 34*b* are inserted between mattress (not shown) and box springs 40 without having to remove mattress (not shown). After a dust ruffle component 70 (not shown) is attached to strip 34*b* and the approximate height from floor is determined, strip 34*b* is fastened to support 30*a* in corner 106 using fastener 80 by first inserting first end 78 into connecting hole 84 of strip 34*b* and then into height adjusting hole 82 of support 30*a* and winding first end 78 around second end 79. Strip 34*b* is also fastened to support 30*b* in corner 107 using fastener 80 by inserting first end 78 into hole 84 of strip 34*b* and then into hole 82 of support 30*b* and winding first end 78 around second end 79. After ruffle 70 (not shown) is attached to strip 34*a* and the approximate height from floor is determined, strip 34*a* is fastened to support 30*b* in corner 108 using fastener 80 by inserting first end 78 into hole 84 of strip 34*a* and then into hole 82 of support 30*b* and winding first end 78 around second end 79. Strip 34*a* is also fastened to support 30*a* in corner 105 using fastener 80 by inserting first end 78 into hole 84 of strip 34*a* and then into hole 82 of support 30*a* and winding first end 78 around second end 79. Since supports 30*a* and 30*b* contain a plurality of height adjusting holes 82, the height of ruffles 70 (not shown) attached to strips 34*a* and 34*b* can be raised or lowered depending on which holes 82 are used when fastening strips 34*a* and 34*b* to supports 30*a* and 30*b*.

Figure 2B:
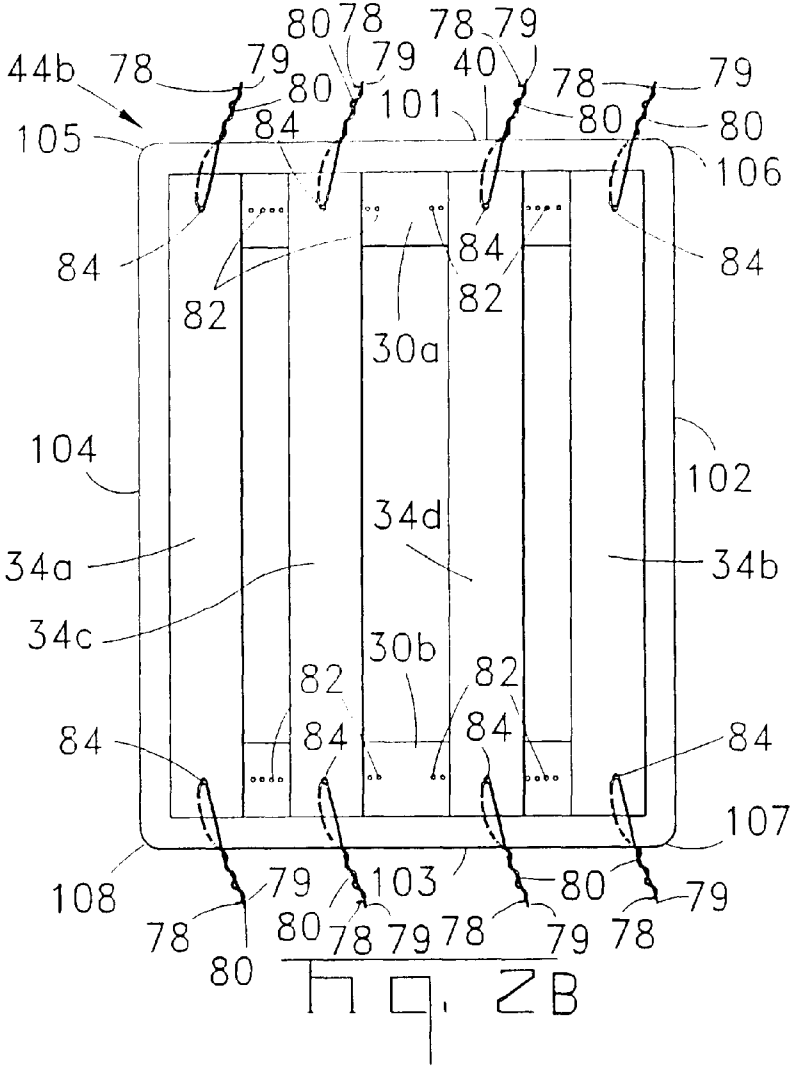
FIG. 2B is a top plan view of the side of bed dust ruffle device of FIG. 2A having four side strips instead of two wherein wire fasteners are utilized to connect the side strips to the support members.
Figure 2A:
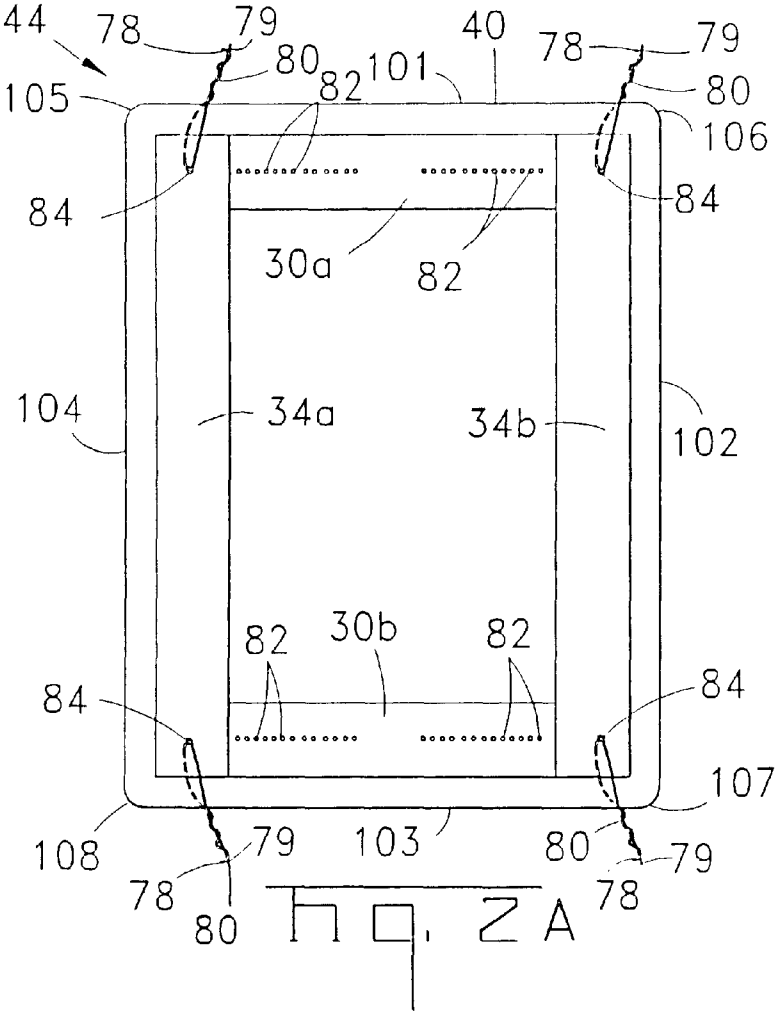
FIG. 2A is a top plan view of the side of bed dust ruffle device having a top end support member, a bottom end support member, and two side strips wherein wire fasteners are utilized to connect the side strips to the support members.

FIG. 2B is an alternative top plan view of device 44 shown in FIG. 2A for creating additional layers of dust ruffles on sides 102 and 104 of box springs 40. Device 44*b* is similar to device 44 shown in FIG. 2A, except that device 44*b* shown in FIG. 2B has additional strips 34*c* and 34*d*. After ruffle 70 (not shown) is attached to strip 34*d* and the approximate height from floor is determined, strip 34*d* is fastened to support 30*a* using fastener 80 by inserting first end 78 into hole 84 of strip 34*d* and then into hole 82 of support 30*a* and then winding first end 78 around second end 79. Strip 34*d* is also fastened to support 30*b* using fastener 80 by inserting first end 78 into hole 84 of strip 34*d* and then into hole 82 of support 30*b* and then winding first end 78 around second end 79. After ruffle 70 (not shown) is attached to strip 34*c* and the approximate height from floor is determined, strip 34*c* is fastened to support 30*a* using fastener 80 by inserting first end 78 into hole 84 of strip 34*c* and then into hole 82 of support 30*a* and then winding first end 78 around second end 79. Strip 34*c* is also fastened to support 30*b* using fastener 80 by inserting first end 78 into hole 84 of strip 34*c* and then into hole 82 of support 30*b* and then winding first end 78 around second end 79. Since supports 30*a* and 30*b* contain a plurality of height adjusting holes 82, the height of ruffles 70 (not shown) attached to strips 34*c* and 34*d* can be raised or lowered depending on which holes 82 are used when fastening strips 34*c* and 34*d* to supports 30*a* and 30*b*. Although only two additional side strips 34*c* and 34*d* are shown, device 44*b* will accommodate additional side strips 34 (not shown) depending on the number of dust ruffle layers desired.

FIG. 3A shows a top plan view of an end of bed dust ruffle device 42 for creating a dust ruffle on bottom end 103 of box springs 40. The end of bed dust ruffle device is comprised of the following: top end strip 20*a* is placed on top of box springs 40 at top end 101; side support members 26*a* and 26*b* are placed on top of box springs 40 at sides 104 and 102; bottom end strip 20*b* is placed on top of box springs 40 at bottom end 103. End strips 20*a* and 20*b* and side support members 26*a* and 26*b* are inserted between mattress (not shown) and box springs 40 without having to remove mattress (not shown). Strip 20*a* is fastened to support 26*a* in corner 105 using fastener 80 by first inserting first end 78 into hole 84 of strip 20*a* and then into hole 84 of support 26*a* and winding first end 78 around second end 79; strip 20*a* is fastened to support 26*b* in corner 106 using fastener 80 by first inserting first end 78 into hole 84 of strip 20*a* and then into hole 84 of support 26*b* and winding first end 78 around second end 79; after ruffle 70 (not shown) is attached to strip 20*b* and the approximate height from floor is determined, support 26*b* is fastened to strip 20*b* in corner 107 using fastener 80 by first inserting first end 78 into hole 84 of strip 20*b* and then into hole 82 of support 26*b* and winding first end 78 around second end 79; support 26*a* is fastened to strip 20*b* in corner 108 using fastener 80 by first inserting first end 78 into hole 84 of strip 20*b* and then into hole 82 of support 26*a* and winding first end 78 around second end 79. Since supports 26*a* and 26*b* contain a plurality of height adjusting holes 82, the height of ruffle 70 (not shown) attached to strip 20*b* can be raised or lowered depending on which holes 82 are used when fastening strip 20*b* to supports 26*a* and 26*b*.

FIG. 3B is an alternative top plan view of end of bed dust ruffle device 42 shown in FIG. 3A for creating additional layers of dust ruffles on bottom end 103 of box springs 40. Device 42*b* is similar to device 42 shown in FIG. 3A, except that device 42*b* shown in FIG. 3B has an additional bottom end strip 20*c*. After ruffle 70 (not shown) is attached to strip 20*c* and the approximate height from floor is determined, strip 20*c* is also fastened to support 26*b* on side 102 using fastener 80 by first inserting first end 78 into hole 84 of strip 20*c* and then into hole 82 of support 26*b* and then winding first end 78 around second end 79. Strip 20*c* is also fastened to support 26*a* on side 104 using fastener 80 by first inserting first end 78 into hole 84 of strip 20*c* and then into hole 82 of support 26*a* and winding first end 78 around second end 79. Since supports 26*a* and 26*b* contain a plurality of height adjusting holes 82, the height of ruffle 70 (not shown) attached to strip 20*c* can be raised or lowered depending on which holes 82 are used when fastening strip 20*c* to supports 26*a* and 26*b*. Although only one additional strip 20*c* is shown, device 42*b* will accommodate additional strips 20 (not shown) depending on the number of dust ruffle layers desired.

Although only one type of fastener component is shown for devices 44, 44*b*, 42, and 42*b* in FIGS. 2A, 2B, 3A, and 3B, any fastener component that adequately performs the function stated herein may be used. For example, a shoe lace (not shown) could be inserted in connecting hole 84 of strip 20*b* shown in FIG. 3A and then inserted into height adjusting hole 82 of support 26*a* and tied together to secure strip 20*b* and support 26*a* together. Additionally, clamping or taping means (not shown) may be employed for fastening purposes.

Figure 4A:
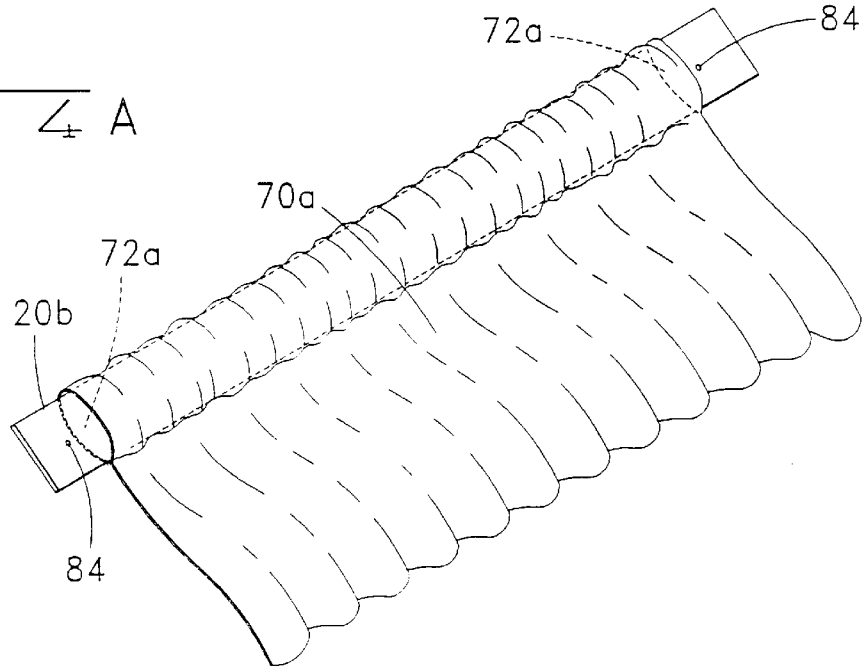
FIG. 4A is a perspective view of the end strip device of FIG. 1A showing a dust ruffle component attached to the end strip device.

FIG. 4A is a perspective view of device 20*b* shown in FIG. 3A where a dust ruffle component 70*a* is attached to bottom end strip 20*b*. Ruffle 70*a* is a layer of material arranged to form a dust ruffle having a pocket-like casing 72*a*. Strip 20*b* slides into casing 72*a* of ruffle 70*a*, and ruffle 70*a* is pulled and gathered to substantially cover the length of strip 20*b*. In the same way as strip 20*b* is attached to ruffle 70*a* in FIG. 4A, side strip 34 (not shown) of device 44 (not shown) slides into casing 72 (not shown) of ruffle 70 (not shown), and ruffle 70 (not shown) is pulled and gathered to substantially cover the length of strip 34 (not shown). Attaching ruffle 70 onto strip 20 or onto strip 34 (not shown) is similar to sliding a curtain (not shown) onto a curtain rod (not shown). Although only one type of dust ruffle component is shown, any dust ruffle component that adequately performs the function stated herein may be used. For example, a layer of material (not shown) and a layer of lining (not shown) can be sewn or attached to form a dust ruffle component (not shown) with a pocket-like casing (not shown). Two or more layers of material (not shown) can be sewn or attached to form a dust ruffle component (not shown) having a pocket-like casing (not shown). After ruffle 70*a* is attached to strip 20*b*, ruffle 70*a* is held is place on strip 20*b* with fasteners 80 (not shown) as described in FIG. 3A After ruffles 70 (not shown) are attached to strips 34 (not shown), ruffles 70 (not shown) are held in place on strips 34 (not shown) with fasteners 80 (not shown) as described in FIG. 2A.

Figure 4B:
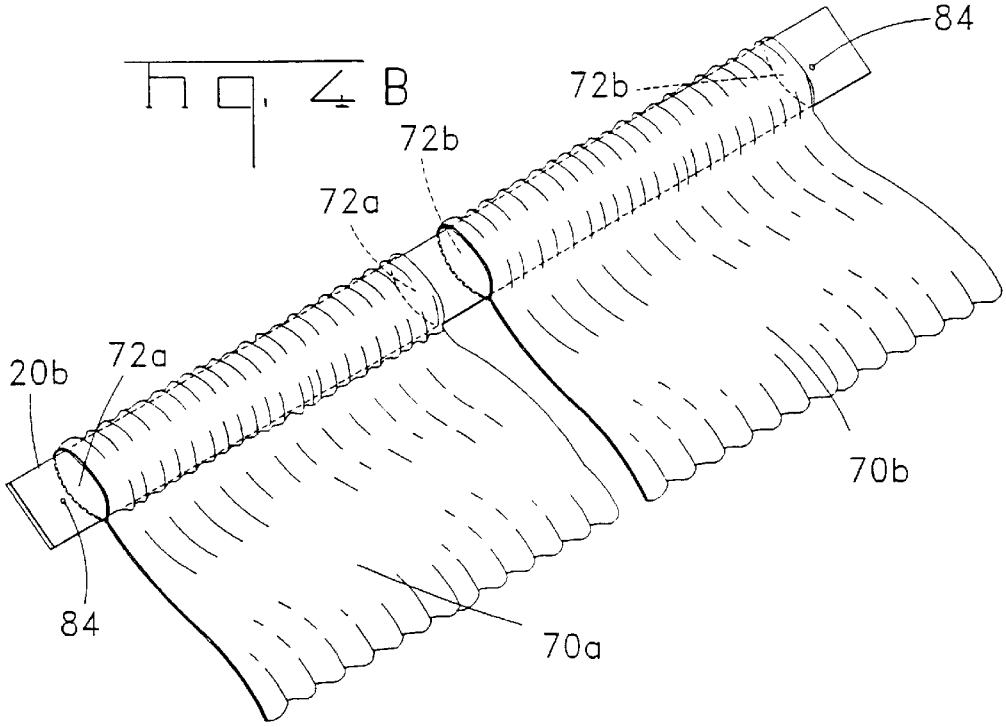
FIG. 4B is a perspective view of the end strip device of FIG. 1A showing two dust ruffle components attached to the end strip device.

An alternative treatment is shown in FIG. 4B where two dust ruffle components 70*a* and 70*b* are attached to bottom strip 20*b* in order to add fullness. Strip 20*b* slides into casing 72*a* of ruffle 70*a* and then into casing 72*b* of ruffle 70*b*, and ruffles 70*a* and 70*b* are pulled and gathered to substantially cover strip 20*b*. In the same way as ruffles 70*a* and 70*b* are attached to strip 20*b* in FIG. 4B, side strip 34 (not shown) of device 44 (not shown) is inserted into more than one casing 72 (not shown) of more than one ruffle 70 (not shown), and more than one ruffle 70 (not shown) is pulled and gathered to substantially cover the length of strip 34 (not shown).

Figure 5A:
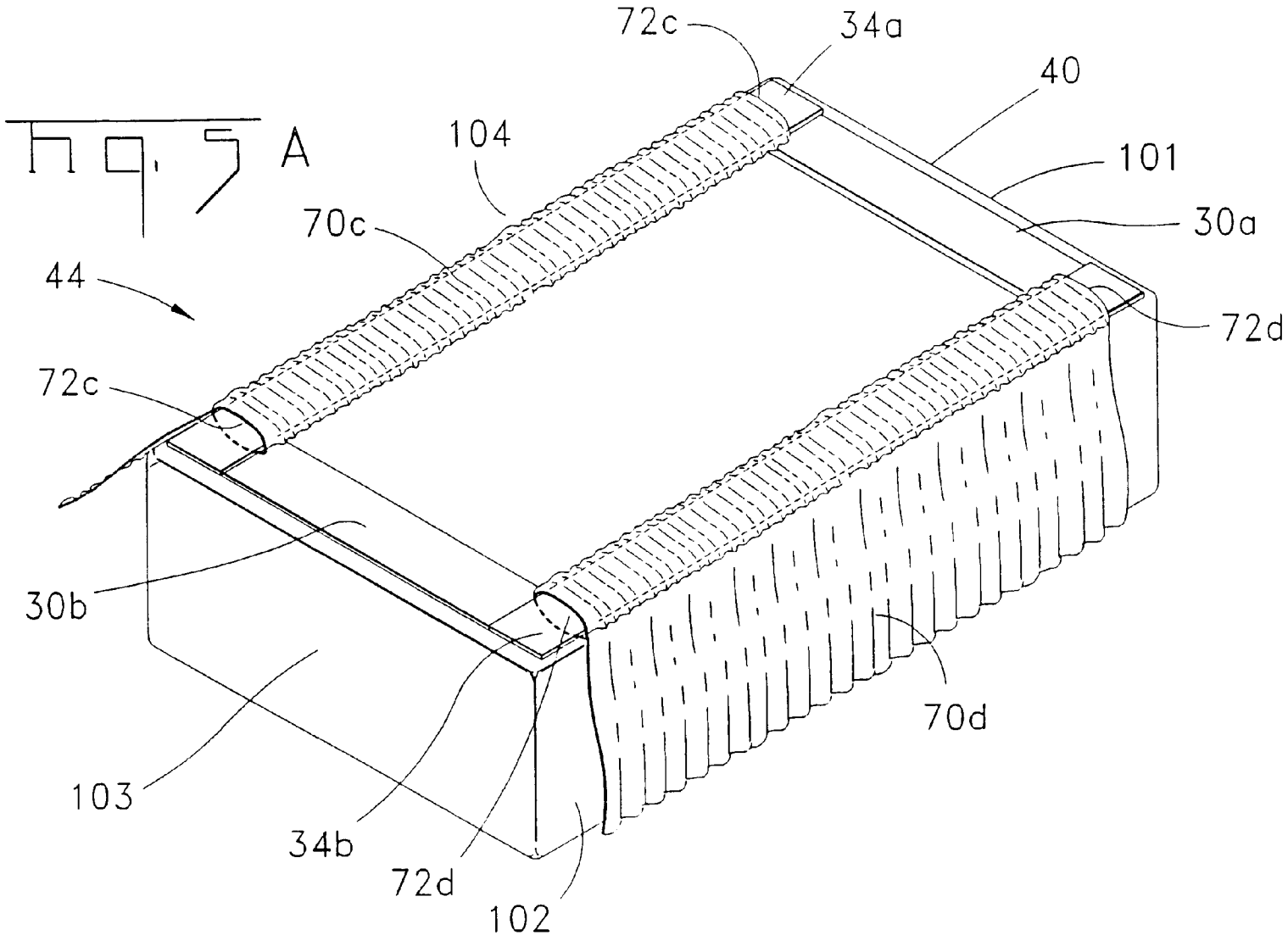
FIG. 5A is a perspective view of a box springs showing the side of bed dust ruffle device of FIG. 2A wherein the dust ruffle components are attached to the side of bed dust ruffle device to form dust ruffles along two sides of the box springs.
Figure 5B:
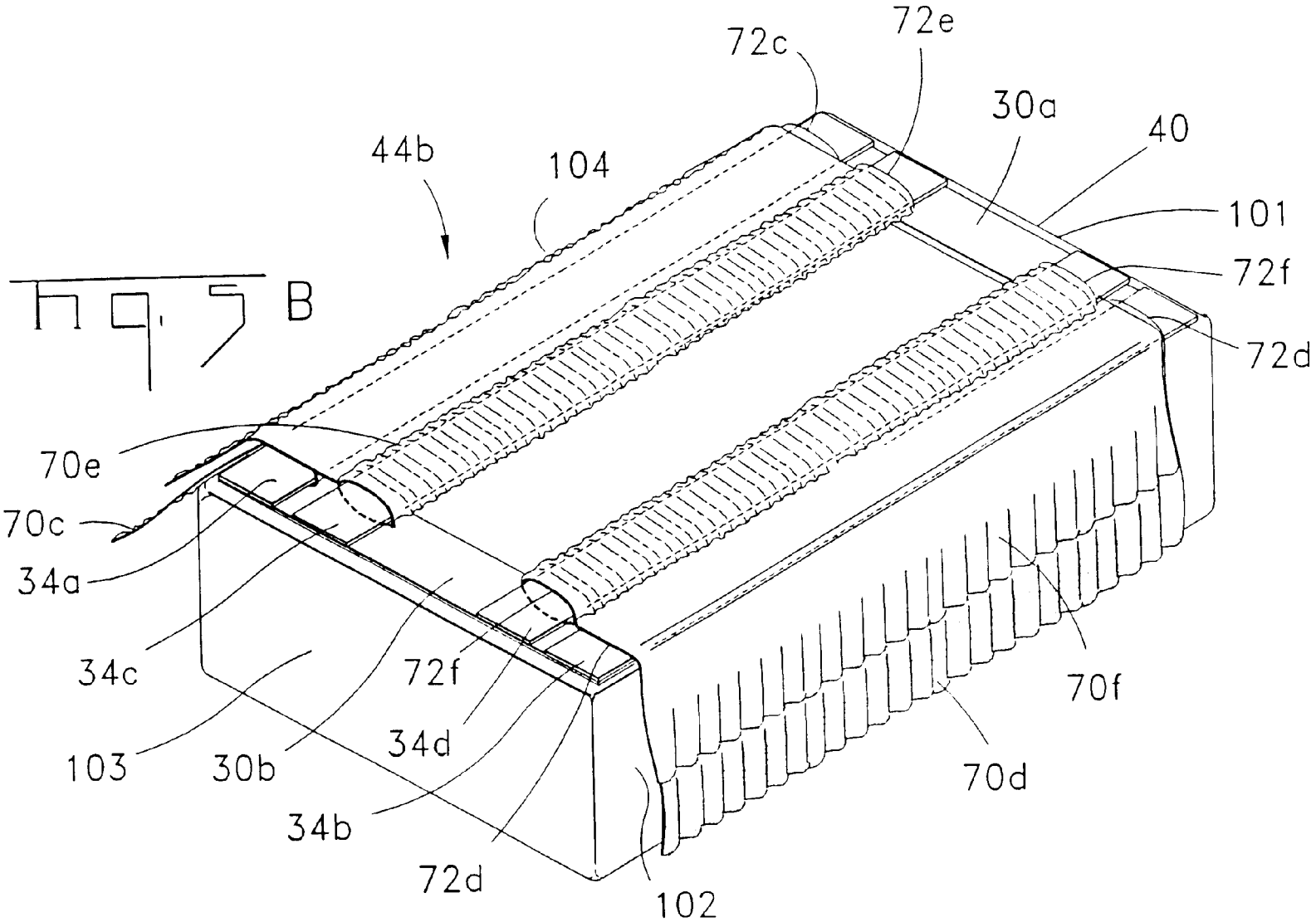
FIG. 5B is a perspective view of a box springs showing the side of bed dust ruffle device of FIG. 2B wherein dust ruffle components are attached to the side of bed dust ruffle device to form two layers of dust ruffles along two sides of the box springs.
Figure 6A:
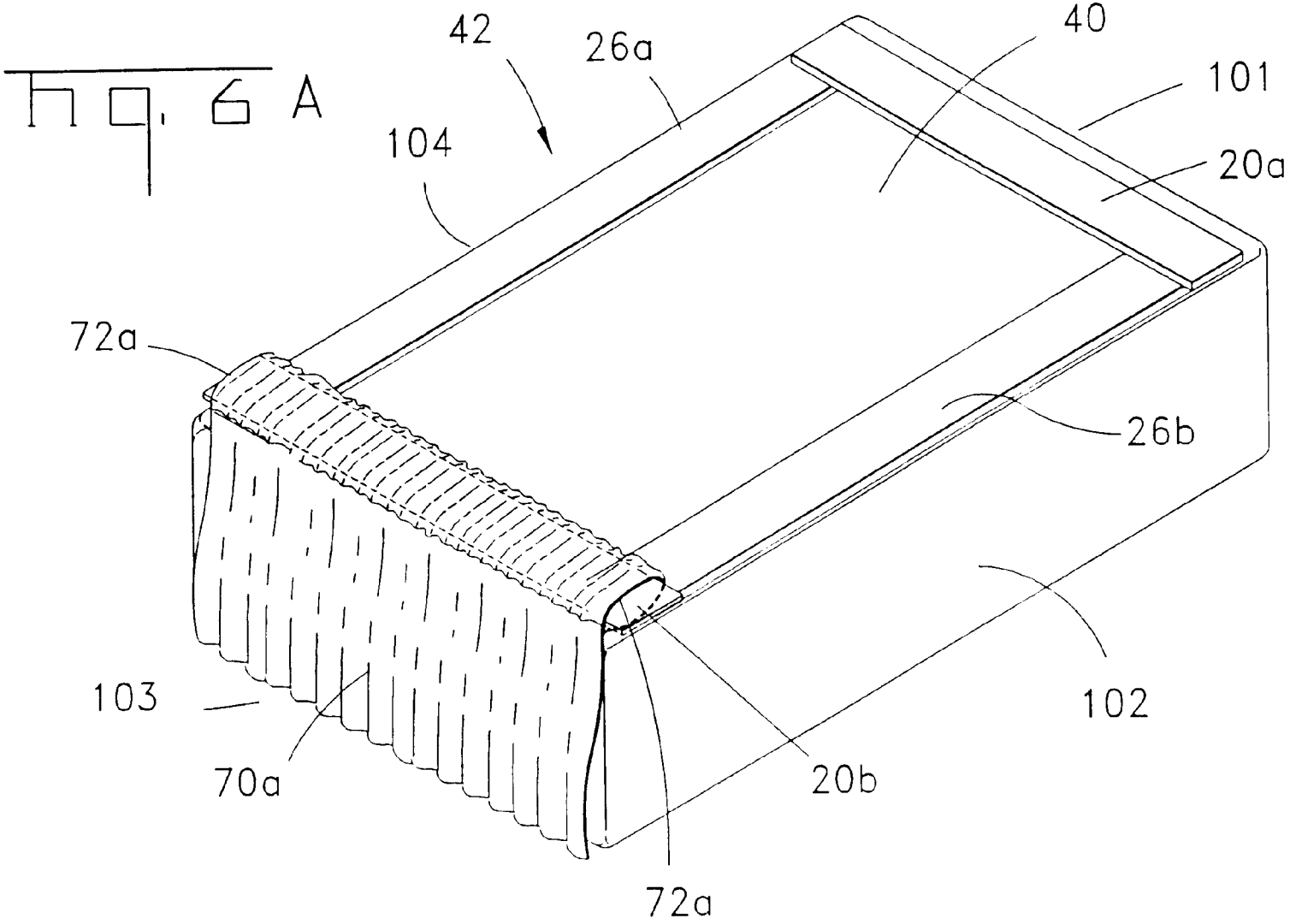
FIG. 6A is a perspective view of a box springs showing the end of bed dust ruffle device of FIG. 3A wherein the dust ruffle component is attached to the end of bed dust ruffle device to form a dust ruffle along the bottom end of the box springs.
Figure 6B:
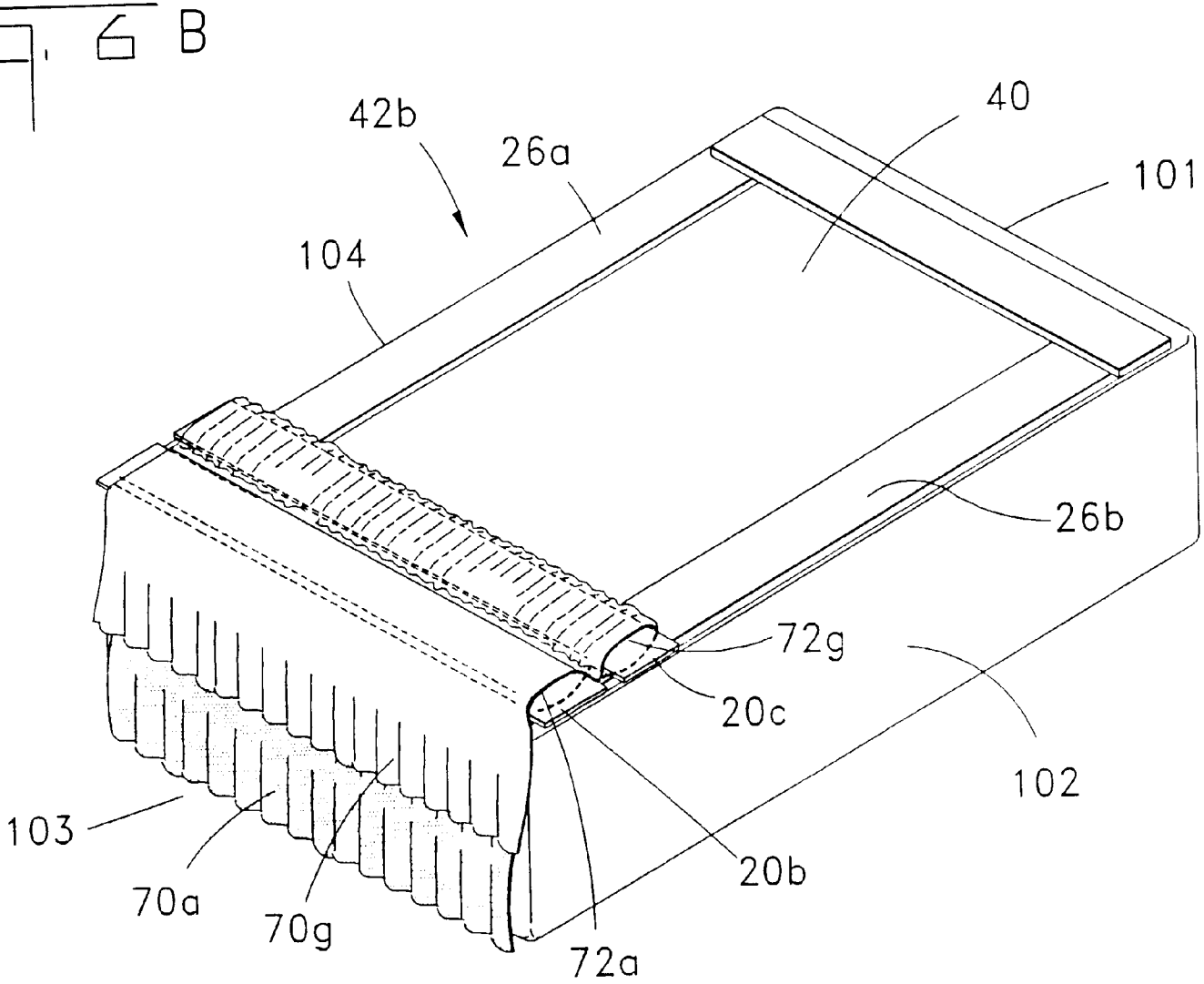
FIG. 6B is a perspective view of a box springs showing the end of bed dust ruffle device of FIG. 3B wherein dust ruffle components are attached to the end of bed dust ruffle device to form two layers of dust ruffles along the bottom end of the box springs.
Figure 7A:
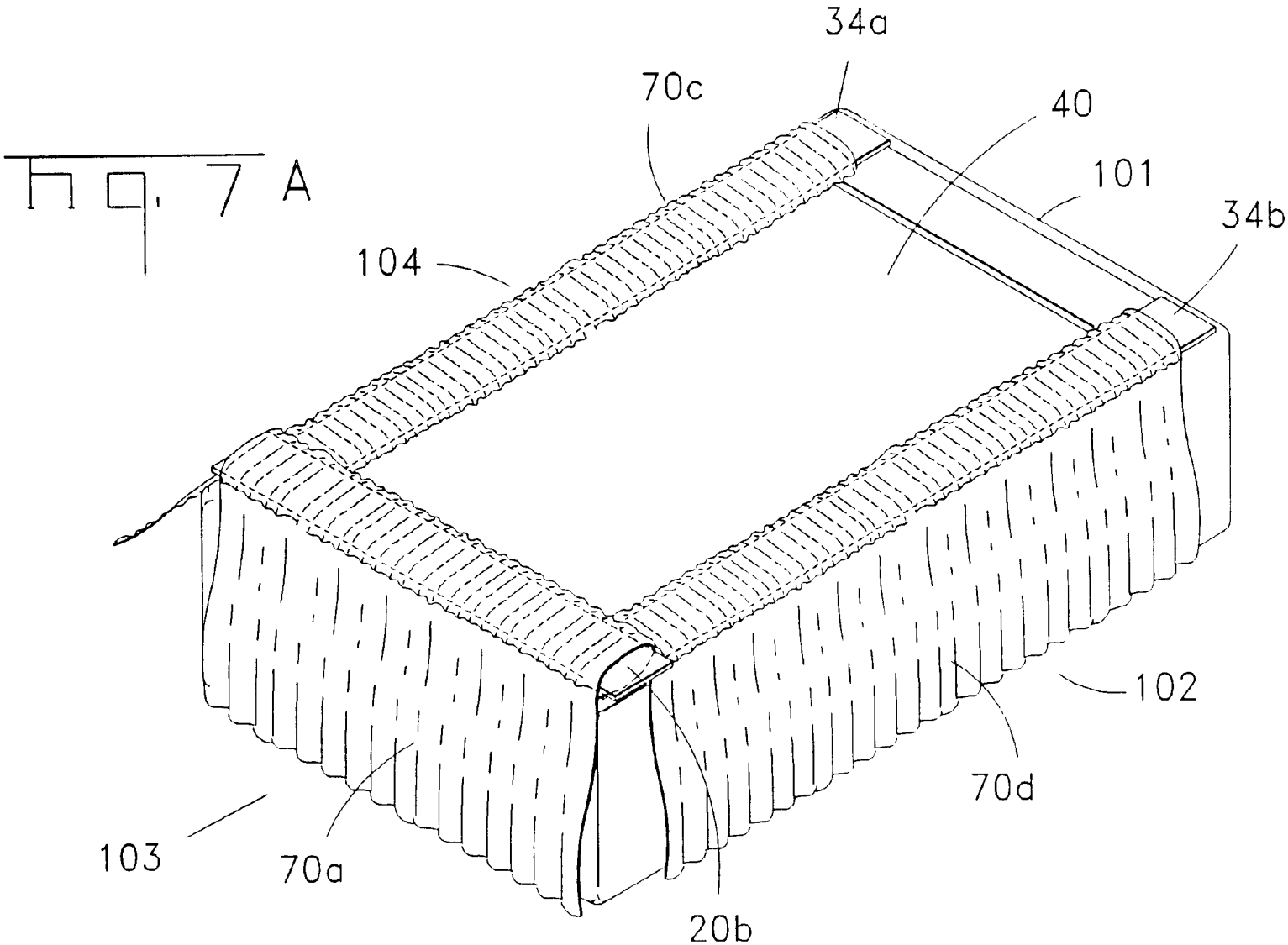
Figure 7B:
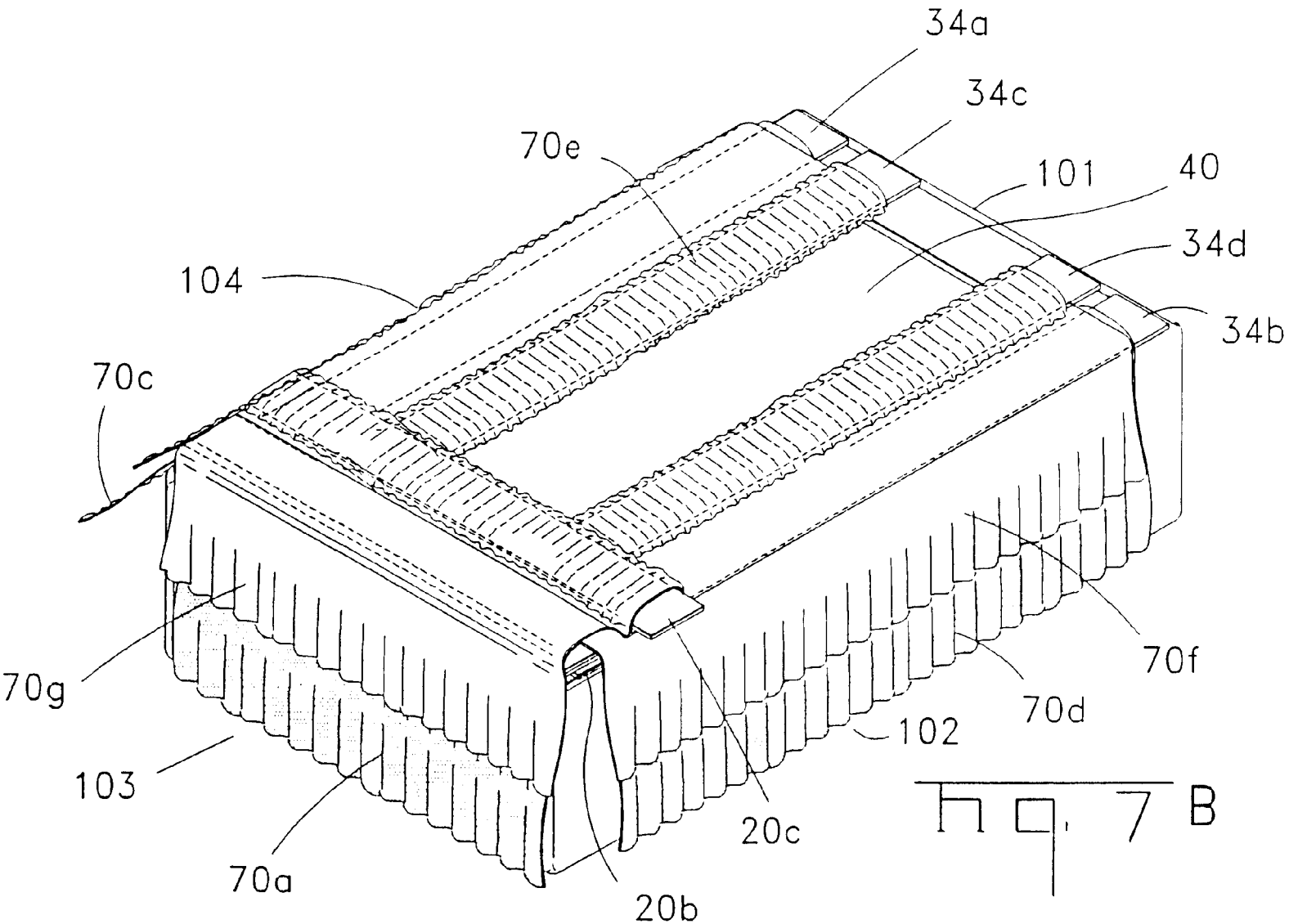

FIGS. 5–7 detail the operation of dust ruffle devices 42 and 44 previously described. The manner of using devices 42 and 44 to hold dust ruffle components is similar to sliding a curtain (not shown) onto a curtain rod (not shown). Devices 42 and 44 are designed to be completely hidden underneath mattress (not shown). Once attached to devices 42 and 44, dust ruffle components 70*d*, 70*a*, and 70*c* hang down over side 102, end 103, and side 104 of box springs 40 thereby forming a dust ruffle. Devices 20, 26, 30, and 34 slide easily between mattress (not shown) and box springs 40 and are easily fastened without removing mattress (not shown). Although the method of operation described herein refers to devices 20 and 26 which each comprise one body member as shown in FIGS. 3A, 3B, 6A, 6B, 7A, and 7B, it should be noted that device 20 may comprise two body members which are connected together as described in FIG. 1A, and device 26 may comprise two body members which are connected together as described in FIG. 1B. Although the method of operation described herein refers to devices 30 and 34 which each comprise one body member as shown in FIGS. 2A, 2B, 5A, 5B, 7A, and 7B, it should be noted that device 30 may comprise two body members which are connected together as described in FIG. 1C, and device 34 may comprise two body members which are connected together as described in FIG. 1D. To change or remove ruffles 70 (not shown) described in FIGS. 2A and 2B, one merely unwinds first ends 78 from second ends 79 of fasteners 80 and then removes fasteners 80 from holes 84 of strips 34 in order to slide ruffles 70 (not shown) off of strips 34. To change or remove ruffles 70 (not shown) described in FIGS. 3A and 3B, one merely unwinds first ends 78 from second ends 79 of fasteners 80 and then removes fasteners 80 from holes 84 of strips 20 in order to slide ruffles 70 (not shown) off of strips 20.

FIG. 5A shows a perspective view of a typical embodiment of device 44 shown in FIG. 2A for creating dust ruffles on sides 102 and 104 of box springs 40. Strip 34*b* slides into casing 72*d* of ruffle 70*d*, and ruffle 70*d* is pulled and gathered to substantially cover the length of strip 34*b*. Strip 34*a* slides into casing 72*c* of ruffle 70*c*, and ruffle 70*c* is pulled and gathered to substantially cover the length of strip 34*a*. Strips 34*a* and 34*b* and supports 30*a* and 30*b* slide in between mattress (not shown) and box springs 40 and are fastened as described in FIG. 2A. Ruffles 70*c* and 70*d* hang down from strips 34*a* and 34*b* of device 44 to create ruffles 70*c* and 70*d* on box springs 40. This embodiment works well with beds (not shown) having foot boards (not shown), where a dust ruffle at end of bed is undesirable. For a day bed (not shown), another embodiment (not shown) for this invention is to use only one ruffle 70*c* or ruffle 70*d* on either strip 34*a* or strip 34*b* depending on the side of bed ruffle 70*c* or ruffle 70*d* is desired. When additional fullness is desired, more than one ruffle 70 (not shown) can be attached to strips 34*a* and 34*b* as described in FIG. 4B.

FIG. 5B shows a perspective view of device 44*b* shown in FIG. 2B for creating two layers of dust ruffles on sides 102 and 104 of box springs 40. Device 44*b* is similar to device 44 shown in FIG. 5A, except that device 44*b* shown in FIG. 5B has additional side strips 34*c* and 34*d* and additional ruffles 70*e* and 70*f* Strip 34*c* slides into casing 72*e* of ruffle 70*e*, and ruffle 70*e* is pulled and gathered to substantially cover the length of strip 34*c*. Strip 34*d* also slides into casing 72*f* of ruffle 70*f* where ruffle 70*f* is pulled and gathered to substantially cover the length of strip 34*d*. Strips 34*c* and 34*d* also slide in between mattress (not shown) and box springs 40 and are fastened as described in FIG. 2B. Ruffles 70*e* and 70*f* hang down from strips 34*c* and 34*d* to form another layer of dust ruffles on box springs 40. When additional fullness is desired, more than one ruffle 70 (not shown) can be added to strips 34*c* and 34*d* as described in FIG. 4B.

FIG. 6A shows a perspective view of a typical embodiment of device 42 shown in FIG. 3A for creating a dust ruffle on end 103 of box springs 40. Bottom end strip 20*b* slides into pocket-like casing 72*a* of dust ruffle component 70*a*, and ruffle 70*a* is pulled and gathered to substantially cover the length of strip 20*b*. Strips 20*a* and 20*b* and supports 26*a* and 26*b* are inserted in between mattress (not shown) and box springs 40 without lifting mattress (not shown) and are fastened as described in FIG. 3A. Ruffle 70*a* hangs down from strip 20*b* to form a dust ruffle on end 103 of box springs 40. When additional fullness is desired, more than one ruffle 70 (not shown) can be attached to strip 20*b* as shown in FIG. 4B.

FIG. 6B shows a perspective view of device 42*b* shown in FIG. 3B for creating two layers of dust ruffles on end 103 of box springs 40. Device 42*b* is similar to device 42 shown in FIG. 6A, except device 42*b* in FIG. 6B has an additional bottom end strip 20*c* and an additional ruffle 70*g*. Strip 20*c* slides into casing 72*g* of ruffle 70*g*, and ruffle 70*g* is pulled and gathered to substantially cover the length of strip 20*c*. Strip 20*c* also is inserted between mattress (not shown) and box springs 40 and is fastened as described in FIG. 3B. Ruffles 70*a* and 70*g* hang down from strips 20*b* and 20*c* to form two layers of dust ruffles on end 103 of box springs 40. When additional fullness is desired, more than one ruffle 70 (not shown) can be attached to strip 20*c* as described in FIG. 4B.

Figure 7B:
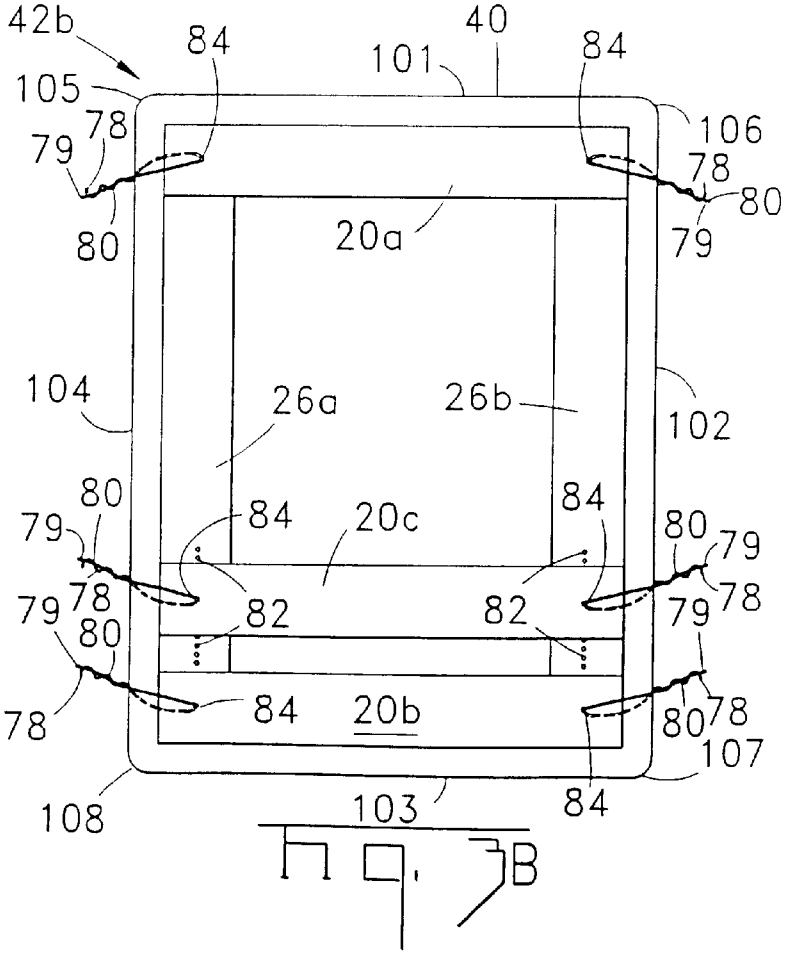
FIG. 7B is a perspective view of a box springs showing the side of bed device of FIG. 5B placed on top of box springs, and the end of bed device of FIG. 6B placed on top of the side of bed device wherein dust ruffle components are attached to the side of bed device and the end of bed device to form two layers of dust ruffles along two sides and the bottom end of the box springs.
Figure 7A:
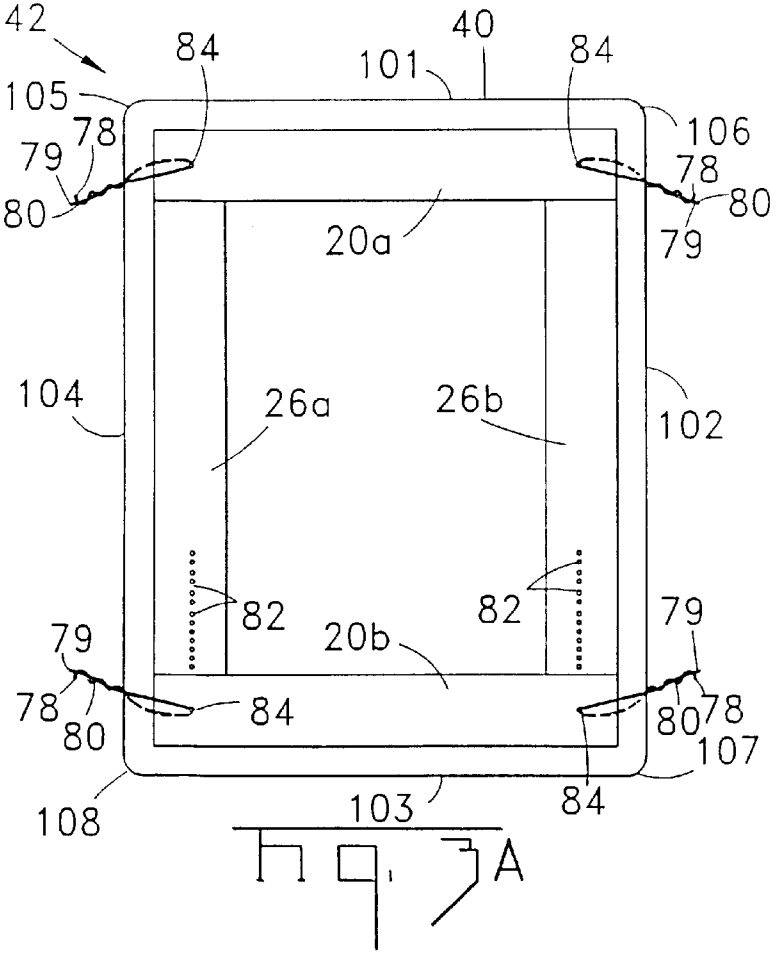
FIG. 7A is a perspective view of a box springs showing the side of bed device of FIG. 5A placed on top of box springs and the end of bed device of FIG. 6A placed on top of the side of bed device wherein dust ruffle components are attached to the side of bed device and the end of bed device to form dust ruffles along two sides and the bottom end of the box springs.

FIG. 7A shows a perspective view of the preferred embodiment of device 42 shown in FIGS. 3A and 6A used together with device 44 shown in FIGS. 2A and 5A for creating dust ruffles on side 102, end 103, and side 104 of box springs 40. Ruffles 70*d*, 70*a*, and 70*c* are attached as described in FIGS. 5A and 6A. Device 44 is inserted between mattress (not shown) and box springs 40 without removing mattress (not shown) as described in FIG. 2A, and device 44 is also fastened as described in FIG. 2A. Device 42 is also inserted between mattress (not shown) and box springs 40 without removing mattress (not shown) as described in FIG. 3A. Device 42 is placed on top of device 44 which is positioned on top of box springs 40. Device 42 is fastened as described in FIG. 3A. Ruffles 70*c*, 70*d*, and 70*a* hang down from strips 34*a*, 34*b*, and 20*b* to form dust ruffles on box springs 40. When additional fullness is desired, more than one ruffle 70 (not shown) can be attached to strips 34*a*, 34*b* and 20*b* as described in FIG. 4B. Another embodiment (not shown) is to use device 44 alone without using device 42 on sleigh beds (not shown), or beds with foot boards (not shown), or day beds (not shown) where a dust ruffle at end of bed is undesirable as discussed in FIG. 5A. By using device 44 and not using device 42 as described in FIG. 5A, dust ruffles can be tailored to suit a bed requiring one or two sides of dust ruffles. By using device 42 with device 44 as shown in FIG. 7A, dust ruffles can be tailored to suit a bed requiring dust ruffles on the bottom end and on two sides.

FIG. 7B shows a perspective view of an alternate, preferred embodiment of device 42*b* shown in FIGS. 3B and 6B and device 44*b* shown in FIGS. 2B and 5B for creating two layers of dust ruffles on side 102, end 103, and side 104 of box springs 40. The devices are similar to devices 44 and 42 shown in FIG. 7A, except devices 44*b* and 42*b* in FIG. 7B have additional strips 34*c*, 34*d* and 20*c*. Ruffles 70*e*, 70*f*, and 70*g* are attached as described in FIGS. 5B and 6B. Device 44*b* is inserted between mattress (not shown) and box springs 40 without removing mattress (not shown) as described in FIG. 2B, and device 44*b* is fastened as described in FIG. 2B. Device 42*b* is also inserted between mattress (not shown) and box springs 40 without removing mattress (not shown) as described in FIG. 3B, and device 42*b* is placed on top of device 44*b* which is positioned on top of box springs 40. Device 42*b* is fastened as described in FIG. 3B. Ruffles 70*a*, 70*g*, 70*c*, 70*d*, 70*e*, and 70*f* hang down from strips 20*b*, 20*c*, 34*a*, 34*b*, 34*c*, and 34*d* to form two layers of dust ruffles on box springs 40. When additional fullness is desired, more than one ruffle 70 (not shown) can be attached to strips 20*b*, 20*c*, 34*a*, 34*b*, 34*c*, and 34*d* as described in FIG. 4B. Another embodiment (not shown) is to use device 44*b* alone without using device 42*b* on sleigh beds (not shown), or beds with foot boards (not shown), or day beds (not shown) where a dust ruffle at end of bed is undesirable as discussed in FIG. 5A. By using device 42*b* with device 44*b* as shown in FIG. 7B, dust ruffles can be tailored to suit a bed requiring layers of dust ruffles on the bottom end and on two sides.

Another embodiment (not shown) of devices 42*b* and 44*b* shown in FIG. 7B allows top end strip 20*a* (not shown) to be removed, so strips 34*a*, 34*b*, 34*c*, and 34*d* and support 26*a* (not shown) and support 26*b* (not shown) can all be fastened to top end support 30*a* (not shown). In this embodiment, device 44*b* is fastened as described in FIGS. 2A and 2B, and supports 26*a* (not shown) and 26*b* (not shown) are fastened to strips 20*b* and 20*c* on end 103 as described in FIGS. 3A and 3B; support 26*a* (not shown) is fastened on end 101 to support 30*a* (not shown) using fastener 80 (not shown) by inserting first end 78 (not shown) into hole 84 (not shown) of strip 26*a* (not shown) and then into hole 82 (not shown) of support 30*a* (not shown) and winding first end 78 (not shown) around second end 79 (not shown); support 26*b* (not shown) is fastened on end 101 to support 30*a* (not shown) using fastener 80 (not shown) by inserting first end 78 (not shown) into hole 84 (not shown) of strip 26*b* (not shown) and then into hole 82 (not shown) of support 30*a* (not shown) and winding first end 78 (not shown) around second end 79 (not shown).

From the description above, a number of advantages of my adjustable dust ruffle device become evident:

a) Dust ruffle devices are interchangeable between beds of different sizes.

b) Dust ruffle components are interchangeable between beds of different sizes.

c) Height of dust ruffle components is adjustable to accommodate bed frames and foundations of various heights.

d) Layers of dust ruffle components can be used and seen using a variety of decorative fabrics, materials, or laces.

e) Dust ruffles can have one, two, or three sides to accommodate box springs resting on bed frames, foundations, poster beds, sleigh beds, day beds, or beds with or without head boards or foot boards.

f) Dust ruffle components can be added to adjust fullness of one or more layers on one or more sides of bed.

g) The fasteners at the ends of each strip permit quick and easy attachment and removal of the dust ruffle components and strips while allowing the support members to remain in place beneath the mattress.

h) The dust ruffle strips are easily unfastened from the support members for removal, cleaning, or changing of the dust ruffle.

i) The entire dust ruffle assembly does not need to be removed for cleaning if only one component is soiled.

SUMMARY, RAMIFICATIONS & SCOPE

Thus, the reader will see the adjustable dust ruffle device easily forms layers of dust ruffles on one, two, or three sides of a bed. In addition to easing installation, the inventive dust ruffle device permits adjustment of the dust ruffle height to accommodate bed frames and foundations of different heights. The device accommodates a range of mattress sizes and also allows dust ruffle components to be interchangeable on beds of different sizes. For example, when a layer of dust ruffles is no longer desired on a queen-size bed, it is easily removed from the queen-size bed and installed on a full-size bed.

The fasteners make removal of the dust ruffle components, side strips, or ends strips convenient and fast while the support members remain in place beneath the mattress. The fullness of each dust ruffle layer is quickly adjusted by adding additional dust ruffle components to one or more strips as desired. The dust ruffle assembly allows more than one fabric to be used which offers many decorating possibilities. For example, a solid fabric used on one dust ruffle layer complements striped, floral, or plaid fabrics used on other dust ruffle layers creating different looks which are easy to change and alternate.

Although the description above contains many specificities, these should not be construed as limiting the scope of the invention but as merely providing illustrations of some of the presently preferred embodiments of this invention. For example, the ends of strips and support members can have other shapes such as triangular, oval, hexagonal, etc.; the wire fasteners which join the strips to the support members can be replaced with clips, clamps, or hook and loop tape. The dust ruffle panels can be smoothly tailored or pleated using pocket-like casings to fit specific sides of specific-size beds when gathered looks are not desired. Tabs of material can be sewn or attached to dust ruffle components to form dust ruffles having tab tops similar to tab top curtains where strips can be inserted into the tabs.

Changes may be made in the embodiments of the invention or in the parts or elements of the embodiments described, or in the steps or sequence of steps of the methods described, without departing from the spirit and/or scope of the invention as defined in the following claims.

I claim:

1. A dust ruffle assembly for use on a bed having a box springs and a mattress, said assembly comprising:

first and second stiffened flexible elongated side strips;

first and second stiffened flexible elongated end support members;

first and second dust ruffle components having predetermined pocket-shaped casings, the first dust ruffle component having the first side strip telescopingly engaged within the pocket-shaped casing of the first dust ruffle component, the second dust ruffle component having the second side strip telescopingly engaged within the pocket-shaped casing of the second dust ruffle component;

each of the first and second side strips being divided into a pair of side sub strips having a proximal end of each side sub-strip in overlapping relationship with a proximal end of the other side sub-strip, a plurality of apertures in each overlapping end of each side sub-strip wherein predetermined apertures of each side sub-strip are aligned to accept fastening means through the aligned predetermined apertures to adjustably fasten the side sub-strips together;

each of the first and second end support members being divided into a pair of support sub-strips having a proximal end of each support sub-strip in overlapping relationship with a proximal end of the other support sub-strip, a plurality of apertures in each overlapping end of each support sub-strip wherein predetermined apertures of each support sub-strip are aligned to accept fastening means through the aligned predetermined apertures to adjustably fasten the support sub-strips together;

each side sub-strip having a distal end in which is located at least one aperture;

each end support sub-strip having a distal end in which is located at least one aperture; and the distal ends of respective side sub-strips being fastened by fastening means through aligned apertures with the distal ends of respective end support sub-strips.

2. A dust ruffle assembly as claimed in claim 1, wherein each side strip has multiple dust ruffle components telescopingly engaged therewith.

3. A dust ruffle assembly as claimed in claim 1, further comprising:

the first and second side strips each have an outwardly facing longitudinal edge and an inwardly facing longitudinal edge, a third and a fourth stiffened flexible elongated side strip, the third side strip being positioned closely adjacent to the inwardly facing longitudinal edge of the first side strip and the fourth side strip being positioned closely adjacent to the inwardly facing longitudinal edge of the second side strip; and third and fourth dust ruffle components each having predetermined pocket-shaped casings, the third dust ruffle component being telescopingly engaged with the third side strip and the fourth dust ruffle component being telescopingly engaged with the fourth side strip, the third and fourth dust ruffle components being positioned to overlay the first and second dust ruffle components to effect a tiered layering of the dust ruffle components.

4. A dust ruffle assembly as claimed in claim 3, further comprising a plurality of dust ruffle components being telescopingly engaged with each side strip.

5. A dust ruffle assembly for use on a bed having a box springs and a mattress, said assembly comprising:

first and second stiffened flexible elongated side strips;

first and second stiffened flexible elongated end support members;

a dust ruffle component having a predetermined pocket-shaped casing, the dust ruffle component having the second end support member telescopingly engaged within the pocket-shaped casing of the dust ruffle component;

each of the first and second side strips being divided into a pair of side sub-strips having a proximal end of each side sub-strip in overlapping relationship with a proximal end of the other side sub-strip, a plurality of apertures in each overlapping end of each side sub-strip wherein predetermined apertures of each side sub-strip are aligned to accept fastening means through the aligned predetermined apertures to adjustably fasten the side sub-strips together;

each of the first and second end support members being divided into a pair of support sub-strips having a proximal end of each support sub-strip in overlapping relationship with a proximal end of the other support sub-strip, a plurality of apertures in each overlapping end of each support sub-strip wherein predetermined apertures of each support sub-strip are aligned to accept fastening means through the aligned predetermined apertures to adjustably fasten the support sub-strips together;

each side sub-strip having a distal end in which is located at least one aperture;

each end support sub-strip having a distal end in which is located at least one aperture; and the distal ends of respective side sub-strips being fastened by fastening means through aligned apertures with the distal ends of respective end support sub-strips.

6. A dust ruffle assembly as claimed in claim 5, wherein the second end support member has multiple dust ruffle components telescopingly engaged therewith.

7. A dust ruffle assembly as claimed in claim 5, further comprising:

wherein the second end support member has an outwardly facing longitudinal edge and an inwardly facing longitudinal edge, a third stiffened flexible elongated end support member, the third end support member being positioned closely adjacent to the inwardly facing longitudinal edge of the second end support member; and a second dust ruffle component having a predetermined pocket-shaped casing, the second dust ruffle component being telescopingly engaged with the third end support member, wherein the second dust ruffle component is positioned to overlay the first dust ruffle component to effect a tiered layering of the dust ruffle components.

8. A dust ruffle assembly as claimed in claim 7, further comprising a plurality of dust ruffle components being telescopingly engaged with each end support member.

9. A dust ruffle assembly for use on a bed having a box springs and a mattress, said assembly comprising:

first and second stiffened flexible elongated side strips;

first and second stiffened flexible elongated end support members, each of the first and second end support members having an outwardly facing longitudinal edge and an inwardly facing longitudinal edge, first, second and third dust ruffle components having predetermined pocket-shaped casings, the first dust ruffle component having the first side strip telescopingly engaged within the pocket-shaped casing of the first dust ruffle component, the second dust ruffle component having the second side strip telescopingly engaged within the pocket-shaped casing of the second dust ruffle component, the third dust ruffle component having the second end support member telescopingly engaged within the pocket-shaped casing of the third dust ruffle is component;

each of the first and second side strips being divided into a pair of side sub-strips having a proximal end of each side sub-strip in overlapping relationship with a proximal end of the other side sub-strip, a plurality of apertures in each overlapping end of each side sub-strip wherein predetermined apertures of each side sub-strip are aligned to accept fastening means through the aligned predetermined apertures to adjustably fasten the side sub-strips together;

each of the first and second end support members being divided into a pair of support sub-strips having a proximal end of each support sub-strip in overlapping relationship with a proximal end of the other support sub-strip, a plurality of apertures in each overlapping end of each support sub-strip wherein predetermined apertures of each support sub-strip are aligned to accept fastening means through the aligned predetermined apertures to adjustably fasten the support sub-strips together;

each side sub-strip having a distal end in which is located at least one aperture;

each end support sub-strip having a distal end in which is located at least one aperture; and the distal ends of respective side sub-strips being fastened by fastening means through aligned apertures with the distal ends of respective end support sub-strips.

10. A dust ruffle assembly as claimed in claim 9, wherein each side strip and the second end support member all have multiple dust ruffle components telescopingly engaged therewith.

11. A dust ruffle assembly as claimed in claim 9, further comprising:

the first and second side strips each have an outwardly facing longitudinal edge and an inwardly facing longitudinal edge, a third and a fourth stiffened flexible elongated side strip, the third side strip being positioned closely adjacent to the inwardly facing longitudinal edge of the first side strip and the fourth side strip being positioned closely adjacent to the inwardly facing longitudinal edge of the second side strip, a third stiffened flexible elongated end support member being positioned closely adjacent to the inwardly facing longitudinal edge of the second end support member;

fourth, fifth and sixth dust ruffle components each having predetermined pocket-shaped casings, the fourth dust ruffle component being telescopingly engaged with the third side strip and the fifth dust ruffle component being telescopingly engaged with the fourth side strip and the sixth dust ruffle component being telescopingly engaged with the third end support member, the fourth, fifth and sixth dust ruffle components being positioned to overlay the first, second and third dust ruffle components respectively to effect a tiered layering of the dust ruffle components.

12. A dust ruffle assembly as claimed in claim 11, further comprising a plurality of dust ruffle components being telescopingly engaged with each side strip and with each end support member.

* * * * *